US008607775B2

(12) United States Patent
Cao et al.

(10) Patent No.: US 8,607,775 B2
(45) Date of Patent: Dec. 17, 2013

(54) CUTTING MACHINE FOR STONE MATERIALS

(75) Inventors: Yang Cao, Nanjing (CN); Banglin Guan, Nanjing (CN); Hongge Wei, Nanjing (CN)

(73) Assignee: Chervon (HK) Limited, Wanchai (HK)

( * ) Notice: Subject to any disclaimer, the term of this patent is extended or adjusted under 35 U.S.C. 154(b) by 349 days.

(21) Appl. No.: 13/071,735

(22) Filed: Mar. 25, 2011

(65) Prior Publication Data

US 2011/0232620 A1 Sep. 29, 2011

(30) Foreign Application Priority Data

Mar. 26, 2010 (CN) ..... 2010 2 0150067

(51) Int. Cl.
*B28D 7/02* (2006.01)
*B28D 1/04* (2006.01)

(52) U.S. Cl.
USPC ..... 125/13.01; 125/13.02; 83/169

(58) Field of Classification Search
USPC ..... 125/13.01, 13.03; 451/455; 83/169
IPC ..... B28D 1/04,7/02
See application file for complete search history.

(56) References Cited

U.S. PATENT DOCUMENTS 1,824,000 A * 9/1931 Walter ..... 125/13.01
2,204,190 A * 6/1940 Siegel ..... 15/257.06
3,635,206 A * 1/1972 Harclerode ..... 125/13.03
4,423,568 A * 1/1984 Gould ..... 451/178
4,446,845 A * 5/1984 Harding ..... 125/13.03
4,779,603 A * 10/1988 Crocetti ..... 125/13.01
4,976,251 A * 12/1990 Smith ..... 125/13.01
5,282,293 A * 2/1994 Pedoeem ..... 16/342
5,404,611 A * 4/1995 Raney ..... 15/257.06
5,741,175 A * 4/1998 Voege ..... 451/455
6,000,387 A * 12/1999 Lee ..... 125/13.01
6,102,235 A * 8/2000 Stern et al. ..... 220/212
6,438,800 B1 * 8/2002 Narang et al. ..... 16/389
6,796,890 B1 * 9/2004 Goldrick ..... 451/454
6,880,543 B2 * 4/2005 Bradfield ..... 125/12
7,013,884 B2 * 3/2006 Guth ..... 125/13.01
7,406,962 B1 * 8/2008 Chen ..... 125/13.01
7,484,637 B2 * 2/2009 Cutler et al. ..... 220/570
D624,946 S * 10/2010 Hutchins ..... D15/133
2003/0051720 A1 * 3/2003 Bradfield ..... 125/12
2004/0134324 A1 7/2004 Sheddy et al.
2007/0144509 A1 * 6/2007 Li ..... 125/13.01
2008/0173294 A1 * 7/2008 Chen ..... 125/35
2008/0257328 A1 * 10/2008 Sheddy et al. ..... 125/13.01
2009/0266350 A1 * 10/2009 Zhang ..... 125/13.01
2010/0288258 A1 * 11/2010 Cao et al. ..... 125/13.01

* cited by examiner

*Primary Examiner* — Joseph J Hail
*Assistant Examiner* — Marc Carlson
(74) *Attorney, Agent, or Firm* — McDermott Will & Emery LLP

(57) ABSTRACT

The present invention provides a cutting machine for stone materials having a power head part, a bedplate, a frame for supporting the bedplate and a basin disposed under the frame. The present invention may also have an expanded basin disposed outside of the basin and a water-retaining device with an upward slope angle may be arranged on the expanded basin to block splashed muddy water in a multi-directional manner during a cutting operation.

9 Claims, 3 Drawing Sheets

CUTTING MACHINE FOR STONE MATERIALS

CROSS-REFERENCE TO RELATED APPLICATIONS

This application claims priority to CN 201020150067.0, filed Mar. 26, 2010, which is hereby incorporated by reference.

FEDERALLY SPONSORED RESEARCH OR DEVELOPMENT

Not Applicable.

TECHNICAL FIELD

The present invention relates to a cutting machine, more specifically to a cutting machine for cutting stone materials.

BACKGROUND OF THE INVENTION

Typically, a cutting machine for stone materials comprises a power head part, a bedplate, a frame for supporting the bedplate and a basin disposed under the frame. The frame is equipped with a guide rail for the bedplate to slide on. When performing a cutting operation, a work piece to be cut is placed on the bedplate and the bedplate is then moved toward the power head part to perform the cutting operation. The basin has a bottom surface and an upright wall around the periphery of the bottom surface, and receives water therein such that dust and noise pollution during the cutting operation is decreased and is therefore beneficial in protecting the environment and the workers' health. At the same time, the water in the basin also is used to lubricate, cool and decontaminate the saw blade of the power head part to increase the usable life of the cutting tool. In order to further maintain the cleanliness of the environment while not increasing the surface area of the basin, an expanded basin may be provided at a separate position out of the basin. The expanded basin of the cutting machine for stone materials in the prior art extends horizontally in a certain direction or around the circumference of the main basin for receiving water drops or water fog that is splattered out of the main basin. Generally, the orientation of the expanded basin is in accordance with that of the bedplate and is immovable relative to the bedplate. Due to the limitation of assembled angle and size of the expanded basin, the ability to receive the splashed polluted water is poor, which results in pollution of the working environment. To reduce the splashed water, it is generally desired to have a larger expanded basin or to add other devices.

SUMMARY OF THE INVENTION

In an effort to address the deficiencies identified above in the prior art, the present invention provides a cutting machine for stone materials with an expanded basin. The improved expanded basin has a small surface area and can block the splashed polluted water in a multi-directional and tridimensional manner during the cutting operation to keep the working environment clean. The present invention provides a cutting machine for stone materials having a power head part, a bedplate, a frame for supporting the bedplate and a basin disposed under the frame. The cutting machine also may have an expanded basin disposed outside of the basin and a water-retaining device with an upward slope angle arranged on the expanded basin. The expanded basin may have a first connection part connected to one of the frame and the basin. And the expanded basin may also have second connection part which may be substantially perpendicular to the first connection part and may be connected to the other of the frame and the basin when the first connection part is connected to one of them.

Also, either the second connection part or the first connection part may be moveable between a first position and a second position and the first connection part or the second connection part may be located on the frame or the basin connected therewith. The water-retaining device may have a water-retaining plate of which a first end may be movably connected with the expanded basin and the water-retaining device may also have an elastic element acting on the water-retaining plate which may enable a second end of the water-retaining plate be positioned upward and away from the expanded basin.

The water-retaining device of the present invention may further have a central axle for connecting the first end of the water-retaining plate and the elastic element to the expanded basin. It may also have a bend portion which is substantially perpendicular to the body of the central axle arranged on one end of the central axle for locking, and a groove receiving the bend portion arranged in the expanded basin. A hollow portion may also be formed on the expanded basin by removing a portion from the expanded basin and may be located within an area of orthographic projection of the water-retaining plate on the expanded basin.

Incorporating the above elements, the present invention may result in a water-retaining device with an upward slope angle arranged on the expanded basin, which can block splashed muddy water in a multi-directional manner during cutting operation, and at the same time does not influence the operation for cutting workpiece since the workpiece can automatically keep a distance when it touches the water-retaining device. It may also provide a first connection part and a second connection part arranged on the expanded basin which can be used for connecting with one of the frame and the basin respectively, such that the expanded basin is mounted fixedly and firmly. The first connection part may be substantially perpendicular to the second connection part, so that the frame and the basin respectively bear forces from the different directions of the expanded basin and the forces are uniform. Further, the second connection part or the first connection part may be moveable between the first position and the second position, and correspondingly the first connection part or the second connection part may be located on the frame or the basin connected therewith, which can block the splashed muddy water in multiple directions during a cutting operation. Finally, a hollow portion may be formed on the expanded basin by removing a portion of the material of the expanded basin and may be located within an area of orthographic projection of the water-retaining plate on the expanded basin, which can decrease weight of the expanded basin, reduce the materials used and diminish cost.

BRIEF DESCRIPTION OF THE DRAWINGS

To understand the present invention, it will now be described by way of example, with reference to the accompanying drawings in which.

DETAILED DESCRIPTION

Figure 1:
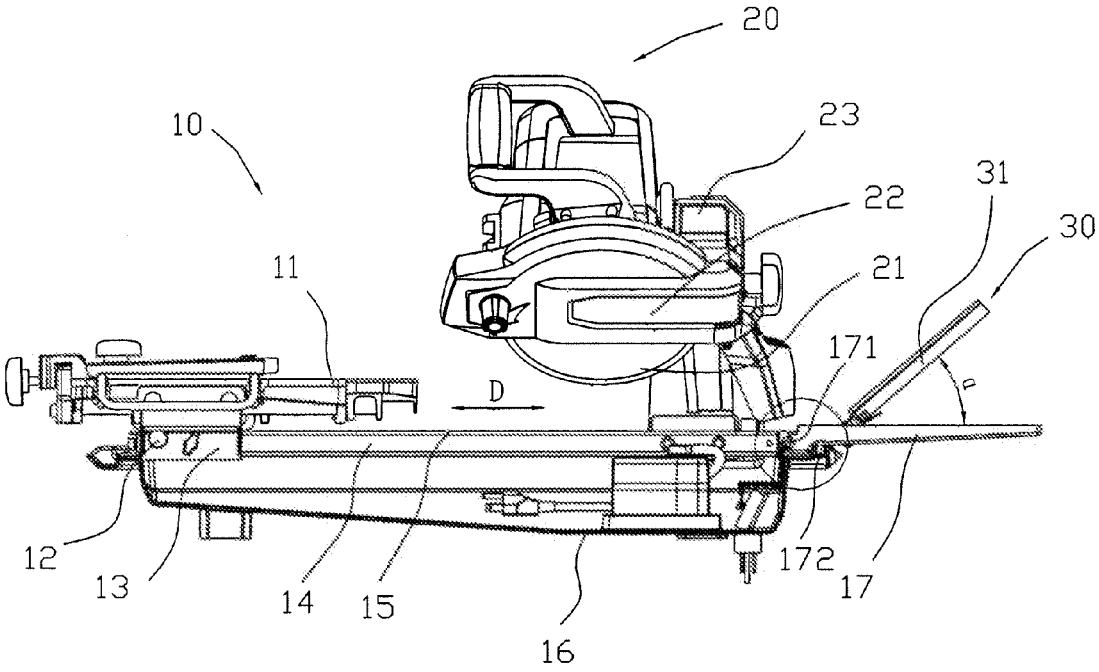
FIG. 1 is a schematic view of a cutting machine for stone materials according to the present invention.

As shown in FIG. 1, it is a schematic view of the cutting machine for stone materials according to the present invention. The cutting machine 10 comprises a bedplate 11, a guide rail 14, a frame 15, a basin 16, an expanded basin 17 and a cutting device 20. The basin 16 is disposed under the frame 15 and serves as a support for the frame 15. Two sides of the frame 15 are respectively equipped with guide rails 14 parallel with each other. The bedplate 11 for supporting the work piece to be cut is disposed on the frame 15 and supported thereon. The bedplate 11 is mounted on the guide rails 14 so as to be slidable along the guide rails. The sliding direction thereof is shown as a double-headed arrow D in FIG. 1. The cutting device 20 is fixed to the guide rail on one side of the frame 15 via a supporting arm, and comprises a motor 23, a saw blade 21 and a saw blade protection device 22. The cutting function of the saw blade 21 can be implemented with the rotation of the saw blade 21 driven by the rotation of the motor 23. The cutting direction of the saw blade 21 is parallel to the sliding direction of the bedplate 11 on the guide rails 14. The expanded basin 17 is mounted outside of the basin 16 for blocking and receiving muddy water displaced from the basin 16 during cutting operation so as to keep the environment clean. A water-retaining device 30 is arranged on the expanded basin 17 and has an upward slope angle $\alpha$ with respect to the workbench surface of the bedplate 11. During the operation of the cutting machine 10, the upward water-retaining device 30 blocks the muddy water displaced by the rotation of the saw blade 21 of the machine. When the bedplate 11 moves towards the cutting device 20 and towards the upward position of the water-retaining device 30, the bedplate 11 can automatically pull and press the upward water-retaining device 30 downward so as not to influence the operation of the cutting machine 10.

As shown in FIGS. 1-4, the expanded basin 17 according to the present invention has a first connection part 171 which is a protruding straight pin extending from the side of the expanded basin and connected to the frame 15. The frame 15 is arranged with a hole 151 to engage with the protruding straight pin. Certainly, a person skilled in the art can readily realize that the structure engaged with the protruding straight pin can also be a groove arranged in the frame 15 instead of the above hole 151. Additionally, the first connection part 171 can also be connected with the basin 16 so as to be mounted in place. To assemble and position the expanded basin 17 and to ensure the reliable actual cutting operation of the machine, the expanded basin 17 according to the present invention further comprises a second connection part 172 that is a projection protruding from the bottom of the expanded basin 17 and is substantially perpendicular to the above first connection part 171. The basin 16 is arranged with a groove 161 to mate with the projection. Certainly, it can be readily realized for a person skilled in the art that the structure mated with the projection can also be a hole arranged in the basin 16 instead of the above groove 161. Additionally, the second connection part 172 can also be connected with the frame 15 or the basin 16 separately so as to be mounted in place. In short, when the first connection part 171 is connected to one of the frame 15 and the basin 16, the second connection part 172 is connected to the other of the frame 15 and basin 16.

Figure 2:
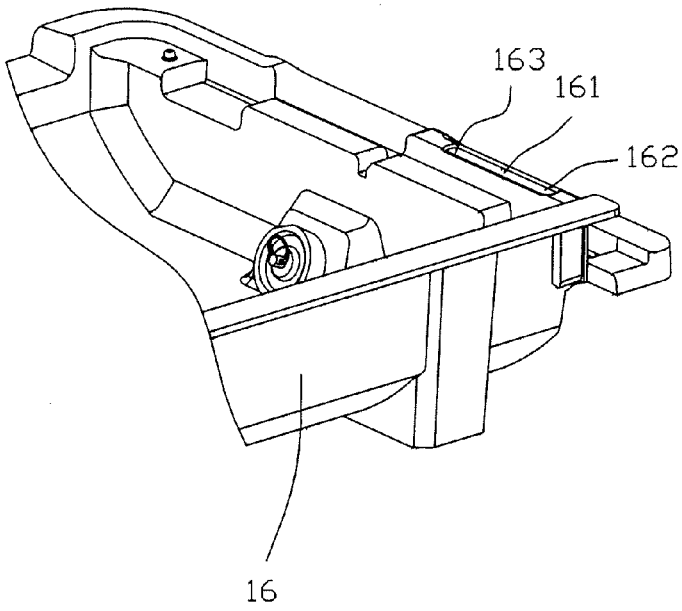
FIG. 2 is a partial view of the basin of the cutting machine for stone materials of the present invention.
Figure 3:
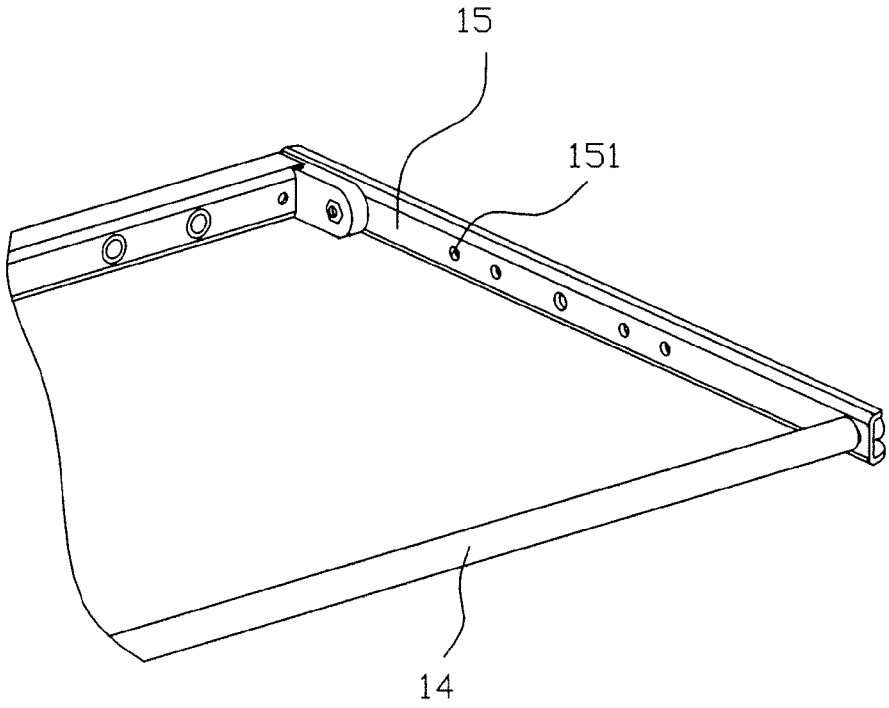
FIG. 3 is a partial view of the frame of the cutting machine for stone materials of the present invention.
Figure 4:
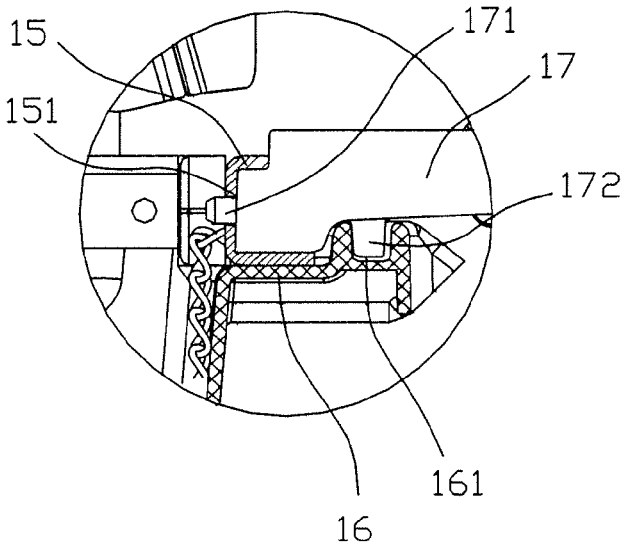
FIG. 4 is a partial enlarged view showing the connection between the expanded basin and the frame of the present invention.

As shown in FIGS. 2 and 3, the same installation mode of the expanded basin 17 according to the present invention has multiple installation positions so as to ensure the best position and retaining qualities. The implementation method thereof is that two or several groups of locating holes 151 or grooves for mating with the straight pin on the expanded basin 17 are located on the main frame 15. The groove 161 or hole in the basin 16 for fixing the expanded basin 17 is an elongated waist groove or waist hole, and the groove 161 has a certain length such that the projection is moveable between a first position 162 and a second position 163 of the groove 161. Therefore, it is provided that the projection on the expanded basin 17 always falls within the groove 161 of the basin when the expanded basin 17 is located in the different groups of holes 151 on the frame 15, so that the function of the expanded basin for moving forth and back is still efficient. The expanded basin can be made smaller by adjusting the installation positions thereof.

It will be known from the above contents by combining with common knowledge in this art that the connection structures for connecting the expanded basin 17 to the frame 15 and the basin 16 can be interchanged so as to obtain the same function with multiple installation positions. Thus, it can be said that the second connection part 172 or the first connection part 171 can be moveable between the first position and the second position, and correspondingly, the first connection part 171 or the second connection part 172 is located on the frame 15 or the basin 16 connected therewith.

Figure 5:
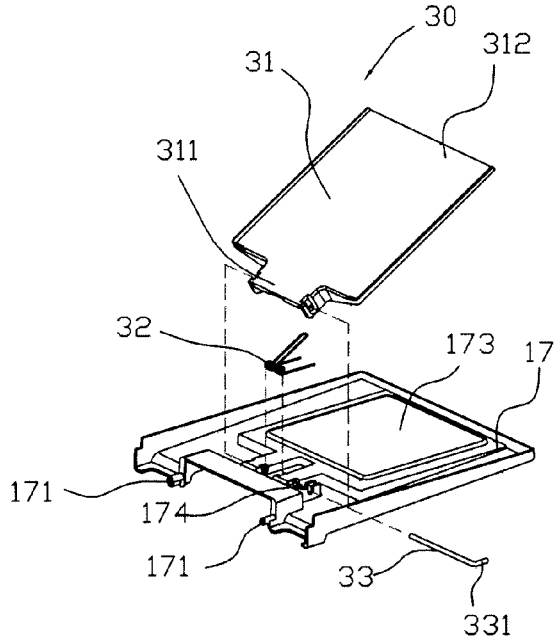
FIG. 5 is a schematic exploded view showing the expanded basin equipped with the water-retaining device of the present invention.

As shown in FIG. 5, it is a schematic exploded view showing the expanded basin equipped with the water-retaining device of the cutting machine for stone materials. The water-retaining device 30 comprises a water-retaining plate 31 having a first end 311 and a second end 312, an elastic element 32 and a central axle 33, wherein the central axle 33 passes through a mounting hole in the expanded basin 17, a central hole of the elastic element and a hole in the first end 311 one by one to connect the first end 311 of the water-retaining plate and the elastic element 32 to the expanded basin 17. At the same time, under the action of the elastic element, the second end 312 of the water-retaining plate tends upwardly away from the expanded basin 17.

A bend portion 331 used for locking is arranged at one end of the central axle 33 of the present invention and is substantially perpendicular to the body of the central axle. At the same time, a groove 174 for receiving the bend portion is arranged on the expanded basin. After assembling the central axle, the central axle can rotate 90° to be latched in the corresponding groove 174 of the expanded basin 17 so that locking of the central axle can be obtained without requirement of nut, clamp spring or other fastening means. In so doing, it simplifies assembly and reduces parts.

The expanded basin 17 of the present invention is configured to form a hollow portion 173 by removing a portion of the material from the expanded basin disposed within the orthographic projection area of the water-retaining plate 31 on the expanded basin 17. This can decrease the weight of the expanded basin, save materials and reduce costs.

The present invention also discloses a fill loading system for lubricating the guide rails of a cutting machine for stone materials. Generally, the types of the guide rails of the cutting machine for stone materials are classified as rolling and sliding. The sliding type usually utilizes the engagement between sliding axle and bearing, and a large amount of pollution will enter into the bearing without protection, which causes the movement of the bearing to be blocked or the cutting operation of the machine to be failed. It can also cause the resistance of movement to be increased and the cutting operation to be difficult even for the bearing with protection because of the consuming of lubricant. Therefore, it becomes essential to refill the guide rails. On the one hand, it removes existing pollution, and on the other hand, it increases lubrication so as to enable the cutting operation to be smooth. Currently, a device composed of a screw and an auxiliary knob can be used for refilling the guide rails of cutting machine. When refilling the cutting machine, the knob is rotated to be opened firstly and then engine oil is injected so as to finish the refilling. Finally the knob is rotated to be closed. However, the knob is easily lost and the operation steps thereof are complicated.

Figure 6:
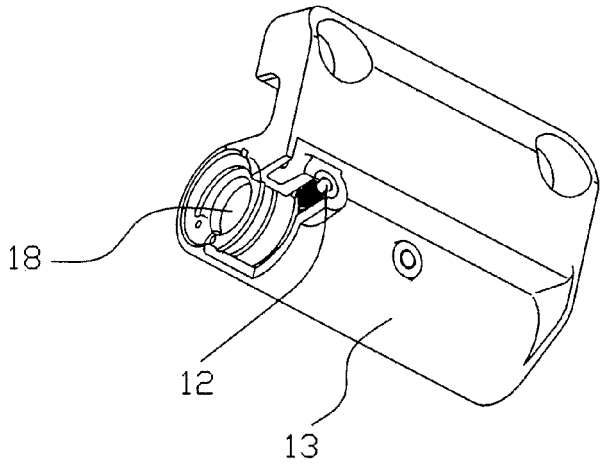
FIG. 6 is a schematic view showing the sliding bar sleeve mounted on the guide rail of the present invention.
Figure 7:
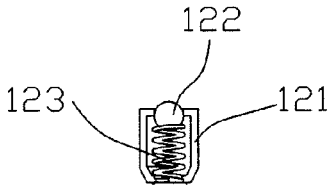
FIG. 7 is a schematic view showing the refilling device arranged on the sliding bar sleeve.

As shown in FIGS. 6 and 7, the sliding bar sleeve 13 is mounted around the guide rails via a central sliding hole 18 thereof, and a filling device 12 comprising an oil cup and an oil can with a sharp nose is arranged on the sliding bar sleeve. The structure of the oil cup comprises a spring 123 arranged within the shell 121 of the oil cup and a steel ball 122 placed on the spring 123. When filling, the sharp nose of the oil can abuts against the steel ball of the oil cup, then the oil can is inserted by exerting a little force and the suitable amount of the oil is squeezed thereinto, and finally the oil can is pulled out after finishing the filling.

The embodiments described above are only explanatory for the concepts and principles of the invention without limitation to the contents of the invention. Various changes and modifications of the embodiments should be considered within the scope of the present application will obviously occur to a person skilled in the art.

What is claimed is:

1. A cutting machine for stone materials, comprising:
a power head part;
a bedplate;
a frame for supporting the bedplate;
a basin disposed under the frame;
an expanded basin disposed outside of the basin;
a water-retaining device with an upward slope angle arranged on the expanded basin;
wherein the water-retaining device further comprises a water-retaining plate comprising a first end movably coupled to the expanded basin and a second end, an elastic element that acts on the water-retaining plate to make the second end thereof tend upwardly away from the expanded basin, and a central axle that couples the first end of the water-retaining plate and the elastic element to the expanded basin; and
a bend portion for locking is arranged on one end of the central axle substantially perpendicular to a body of the central axle, and a groove for receiving the bend portion is arranged in the expanded basin.

2. The cutting machine for stone materials according to claim 1, wherein the expanded basin has a first connection part connected to at least one of the frame and the basin.

3. The cutting machine for stone materials according to claim 2, wherein the expanded basin further comprises a second connection part which is substantially perpendicular to the first connection part and is connected to the other of the frame and the basin when the first connection part is connected to at least one of the frame and the basin.

4. The cutting machine for stone materials according to claim 3, wherein the second connection part or the first connection part is moveable between a first position and a second position, and one of the first connection part and the second connection part is located on one of the frame and the basin connected therewith.

5. The cutting machine for stone materials according to claim 1, wherein a hollow portion is formed on the expanded basin by removing a portion of the expanded basin located within an area of orthographic projection of the water-retaining plate on the expanded basin.

6. A cutting machine for stone materials, comprising:
a power head part;
a bedplate;
a frame for supporting the bedplate;
a basin disposed under the frame;
an expanded basin disposed outside of the basin;
a water-retaining device with an upward slope angle arranged on the expanded basin;
wherein the water-retaining device further comprises a water-retaining plate comprising a first end movably coupled to the expanded basin, an elastic element that acts on the water-retaining plate to make a second end thereof tend upwardly away from the expanded basin, and a central axle that couples the first end of the water-retaining plate and the elastic element to the expanded basin;
a bend portion for locking is arranged on one end of the central axle substantially perpendicular to a body of the central axle, and a groove for receiving the bend portion is arranged in the expanded basin; and,
the expanded basin has a first connection part connected to at least one of the frame and the basin and has a second connection part which is substantially perpendicular to the first connection part and is connected to the other of the frame and the basin when the first connection part is connected to at least one of the frame and the basin.

7. The cutting machine for stone materials according to claim 6, wherein the second connection part or the first connection part is moveable between a first position and a second position, and one of the first connection part and the second connection part is located on one of the frame and the basin connected therewith.

8. The cutting machine for stone materials according to claim 6, wherein a hollow portion is formed on the expanded basin by removing a portion of the expanded basin located within an area of orthographic projection of the water-retaining plate on the expanded basin.

9. A cutting machine for stone materials, comprising:
a power head part;
a bedplate;
a frame for supporting the bedplate;
a basin disposed under the frame, wherein the cutting machine further comprises an expanded basin disposed outside of the basin, and a water-retaining device with an upward slope angle arranged on the expanded basin and wherein the water-retaining device comprises a water-retaining plate having a first end movably coupled to the expanded basin;
the expanded basin has a first connection part connected to at least one of the frame and the basin and has a second connection part which is substantially perpendicular to the first connection part and is connected to the other of the frame and the basin when the first connection part is connected to at least one of the frame and the basin wherein the second connection part or the first connection part is moveable between a first position and a second position, and one of the first connection part and the second connection part is located on one of the frame and the basin connected therewith; and, wherein the water-retaining device further comprises an elastic element which acts on the water-retaining plate to make a second end thereof tend upwardly away from the expanded basin and wherein a bend portion for locking is arranged on one end of the central axle substantially perpendicular to a body of the central axle, and a groove for receiving the bend portion is arranged in the expanded basin.

* * * * *